United States Patent [19]

Ezawa

[11] 4,424,730

[45] Jan. 10, 1984

[54] ELECTRONIC MUSICAL INSTRUMENT

[75] Inventor: Sadaaki Ezawa, Shizuoka, Japan

[73] Assignee: Kabushiki Kaisha Kawai Gakki Seisakusho, Japan

[21] Appl. No.: 324,849

[22] Filed: Nov. 25, 1981

[30] Foreign Application Priority Data

Nov. 28, 1980 [JP] Japan ..... 55-167865

[51] Int. Cl.[3] ..... G10H 1/00

[52] U.S. Cl. ..... 84/1.01; 84/1.03; 364/718

[58] Field of Search ..... 84/1.01, 1.03, 1.24; 364/718, 721; 328/15, 16; 307/271

[56] References Cited

U.S. PATENT DOCUMENTS 4,345,500 8/1982 Alonso et al. ..... 328/16 X 4,373,416 2/1983 Endo et al. ..... 84/1.01

OTHER PUBLICATIONS

Snell, Design of a Digital Oscillator which will Generate up to 256 Low-Distortion Sine Waves in Real Time, Computer Music Journal, vol. 1, No. 2, Apr. 1977.

*Primary Examiner*—F. W. Isen

*Attorney, Agent, or Firm*—McGlew and Tuttle

[57] ABSTRACT

An electronic musical instrument which can be manufactured at low cost using a system of generating frequency information corresponding to the note of each key as a frequency number on a non-real time basis. The electronic musical instrument is provided with a frequency number memory for storing the frequency number corresponding to the note of each key and delivering the frequency number corresponding to key information from a key assignor, means for executing an operation in units of the delivered frequency number a plurality of times and transferring the operation result to a buffer memory upon each execution of the operation, and a memory for storing the results of the operation executed the plurality of times.

3 Claims, 5 Drawing Figures

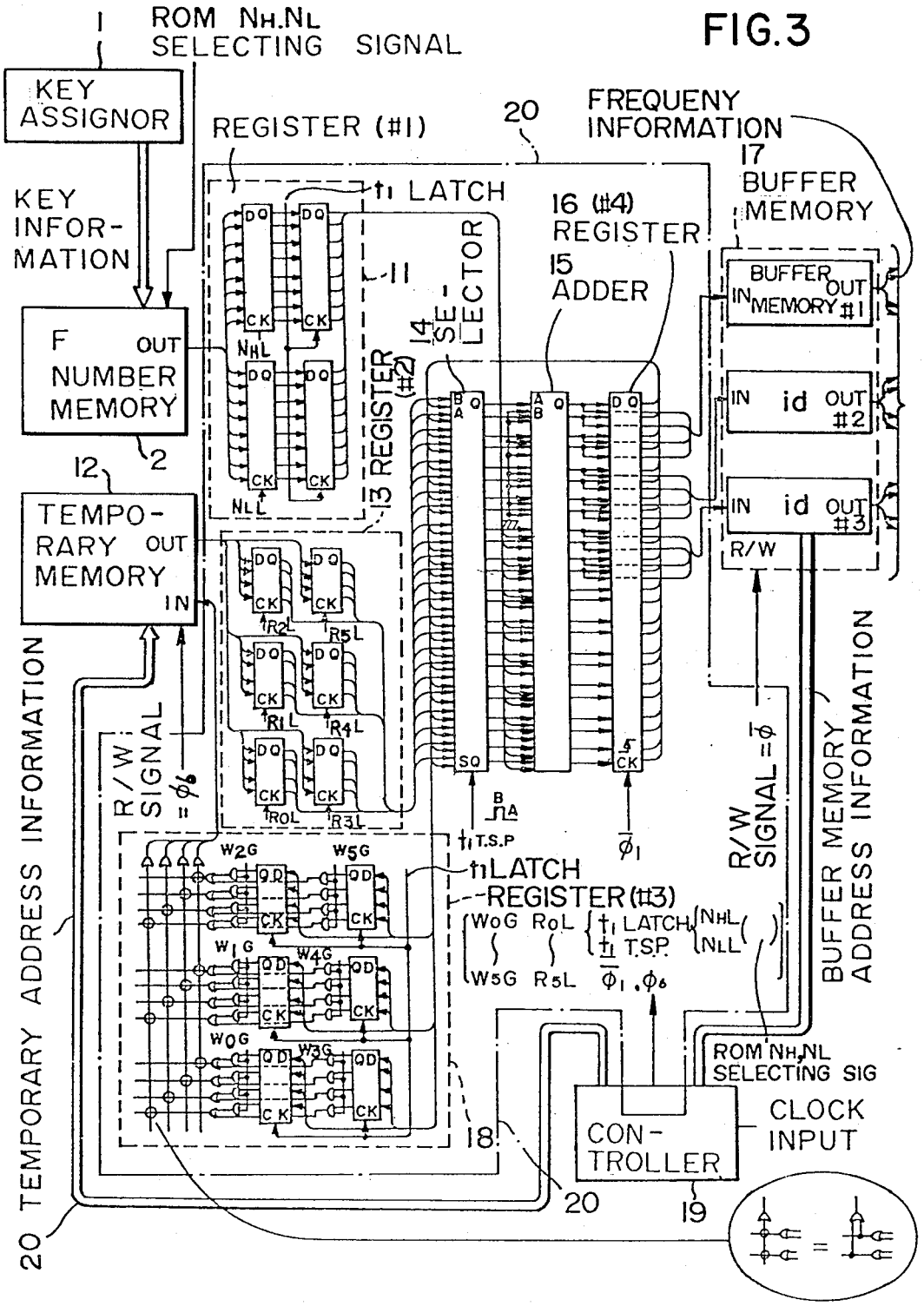
FIG.3
1
ROM NH.NL SELECTING SIGNAL
KEY ASSIGNOR
KEY INFOR-MATION
F NUMBER MEMORY
OUT
2
12
TEMPO-RARY MEMORY
OUT
IN
REGISTER (#1)
20
FREQUENY INFORMATION
17
BUFFER MEMORY
t1 LATCH
16 (#4) REGISTER
15 ADDER
11
14 SE-LECTOR
13 REGISTER (#2)
BUFFER MEMORY
IN
OUT #1
id
OUT #2
OUT #3
R/W
R/W SIGNAL
t1 T.S.P
t1 LATCH
REGISTER (#3)
W0G R0L
W5G R5L
NHL
NLL
ROM NH,NL SELECTING SIG
CLOCK INPUT
CON-TROLLER
18
19
20
20 TEMPORARY ADDRESS INFORMATION
BUFFER MEMORY ADDRESS INFORMATION KEY INFORMATION INPUT SLOT a
OPERATION SLOT b
TEMPORARY MEMORY READ/WRITE SLOT c
Φ0 (2MHz)
Φ1 (1MHz)
Φ2 (500KHz)
Φ3 (250KHz)
Φ4 (125KHz)
Φ5 (62.5KHz)
Φ6 (31.25KHz)
d
Wn GATE SIGNAL W0G, R0L
Kn LATCH SIGNAL W1G, R1L
W5G, R5L
e
Wn Rn
NH, NL LATCH SIGNAL NHL NLL
f
ROM NH, NL SELECTING SIGNAL
g
t1 LATCH SIGNAL
t1 T·S·P
h
Φ2'
i
32μ
16μ
1CH
16CH
15CH
2CH
3CH
4CH

ELECTRONIC MUSICAL INSTRUMENT

BACKGROUND OF THE INVENTION

1. Field of the Invention

The present invention relates to an electronic musical instrument which can be constituted at low cost using a system of the type in which frequency information corresponding to the note of a key is generated as a frequency number on a non-real time basis.

2. Description of the Prior Art

Heretofore, there has been employed in electronic musical instruments a system which is provided with means for generating as a frequency number, frequency information corresponding to a key and accumulates it on a real time basis, as proposed, for example, in U.S. Pat. No. 3,743,755. FIG. 1 is a block diagram showing the arrangement of such a prior art system. In FIG. 1, a frequency number (an F number) corresponding to key information derived from a key assignor 1 is read out from an F number memory 2 which is frequency number generating means, and a shift register 4 is shifted by a shift clock in synchronism with the timing at which the key information is provided. By an accumulator arranged to feed back the output from the shift register 4 to an adder 3, the F number is accumulated to obtain frequency information. In this case, the system arrangement is very simple but it has turned out that if the system is equipped with an actually required scale and functions, the cost of the shift register 4 would be unexpectedly high; hence, the conventional system is not always practical. The reason is as follows:

Consider the access time of the F number memory 2. Assuming, for example, that the sample frequency of the frequency information is 62.5 KHz, and that the key assignor 1 assigns 16 channels, for example, eight channels for an upper keyboard, seven channels for a lower keyboard and one channel for a pedal keyboard, the conventional shift register 4 is required to have 16 stages and the shift clock is of $16\times62.5$ KHz$=1$ MHz. Accordingly, it is desirable to execute an F number access from the F number memory 2 and the additive operation within a period of one $\mu$s.

Further, for obtaining sufficient frequency accuracy, 22 or more bits, for example, 24 bits are necessary. In the case of forming a gate circuit by individual parts as of TTL, its operating speed is not so important but its cost is high. When using, for example, a master slice system of a semi-custom LSI composed of CMOS's which is considered to be less costly, a period of about 500 nanoseconds is required for the abovesaid addition, so that the F number memory 2 must be formed by an element which is of short access time and consequently expensive.

In the case where the shift register 4 is a 24-bit, 16-stage shift register and is formed as an LSI, seven gates are needed for each stage of the shift register; namely, $24\times16\times7=2688$ gates are required in all and even these gates alone cannot be accomodated in a general purpose master slice system. If these gates are provided externally, then 48 lines, that is, 24 connection lines between the adder 3 and the shift register 4 and 24 feedback lines from the shift register 4 are connected with pins of the master slice, but the existing master slice has only about 56 pins, and hence it is short of pins as a whole and cannot be employed. With a novel master slice, the use of the semi-custom LSI loses its meaning and the cost becomes rather high.

SUMMARY OF THE INVENTION

It is therefore an object of the present invention to provide an electronic musical instrument which employs the system of generating frequency information as a frequency number and is suitable for fabrication as a semi-custom LSI using inexpensive elements.

Another object of the present invention is to provide an electronic musical instrument which employs a complete master-slice arrangement between a buffer memory and a temporary memory and is stable in performance without using a large capacity shift register.

Briefly stated, the electronic musical instrument of the present invention is characterized by the provision of a frequency number memory for storing frequency numbers respectively corresponding to the notes of keys and sending out the frequency number corresponding to key information from a key assignor, means for executing an operation in units of the frequency number a plurality of times and transferring the result of each operation to a buffer memory, and a memory for storing the operation results.

BRIEF DESCRIPTION OF THE DRAWINGS

FIG. 3 is a detailed explanatory diagram of the embodiment shown in FIG. 2;

DESCRIPTION OF THE PREFERRED EMBODIMENTS

Figure 2:
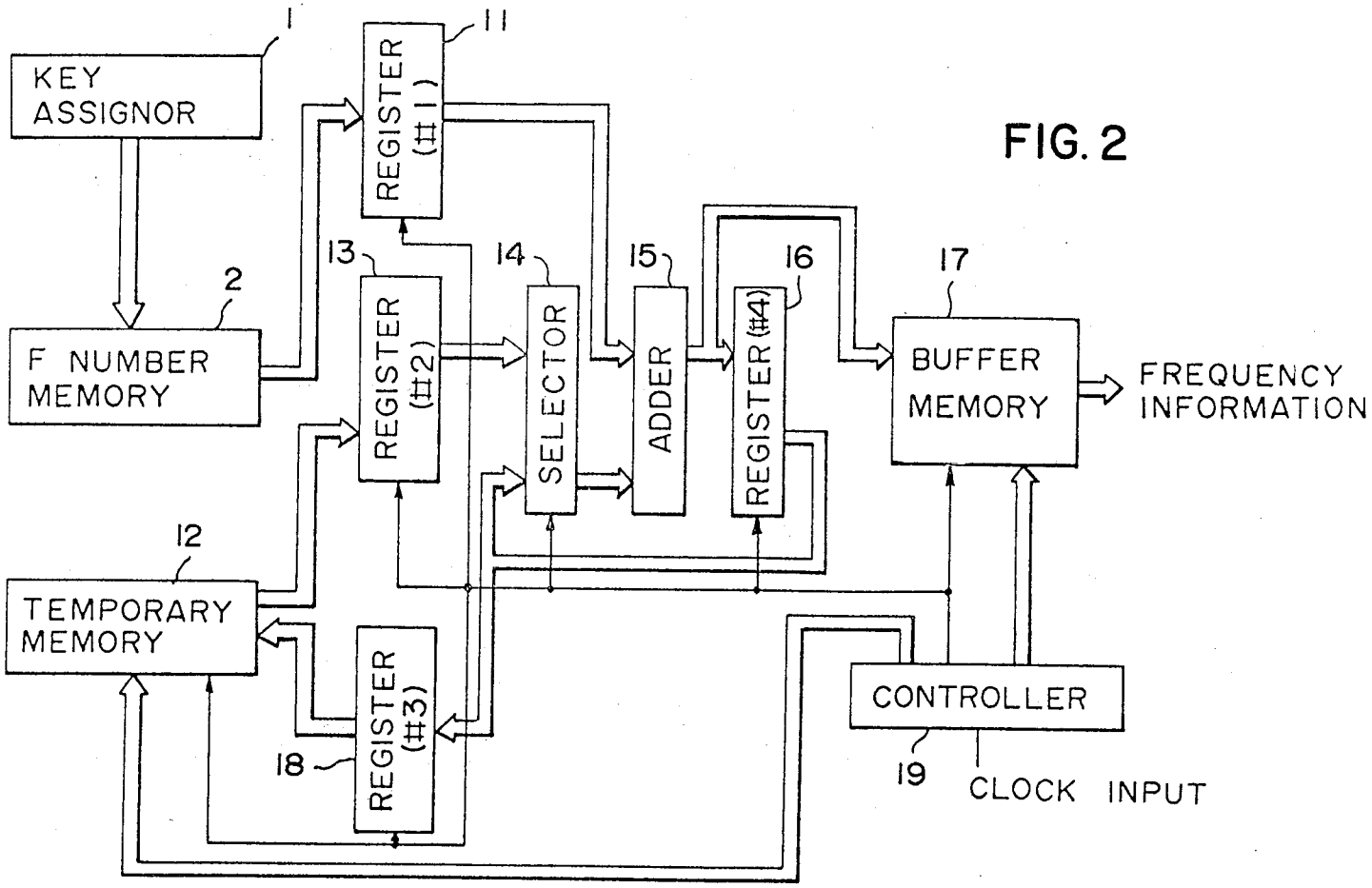
FIG. 2 is a block diagram illustrating the arrangement of an embodiment of the present invention.

Referring first to FIG. 2, the present invention will be described in detail.

In the present invention, a frequency number (F number) is accumulated on a non-real time basis and the operation result is stored in a buffer memory by making use of a write slot of the buffer memory which is subject to time-division control in its read and write slots, while at the same time frequency information is read out from the buffer memory utilizing its read slot. In FIG. 2, when the F number corresponding to key information from the key assignor 1 is read out from the F number memory 2, it is stored in a register (#1)11. At the same time, the content of a temporary memory 12 which has stored therein the result of a previous accumulation is read out and stored in a register (#2)13, but, in a first readout of the F number memory 2, no content of the temporary memory 12 is read out. In a first accumulation, a selector 14 sends out the output from the register (#2)13 to an adder 15, wherein it is added with the content of the register (#1)11 and the added output is stored in a register (#4)16. Thereafter, the selector 14 sends out the output from the register (#4)16 to the adder 15, executing the accumulation under the control of a control circuit 19. The result of each accumulation is stored in a buffer memory 17 utilizing its write slot. After the accumulation is performed a preset number of times, the accumulation result is stored in a register (#3)18. The content of the register (#3)18 is stored in the temporary memory 12 at the same time as the next key information from the key assignor 1 is processed in the same procedure as mentioned above. The keys which each correspond to a note, are assumed to be part of the key assignor 1.

A detailed description will be given, with reference to FIG. 3, of the operation of this embodiment. In FIG. 3, when the input slot of the key information from the key assignor 1 is a channel 1, an F number corresponding to the key information of the channel 1 is provided from the F number memory 2 and stored in a first stage of the register (#1)11 by latch signals $N_HL$ (for latching the higher order of the F number) and $N_LL$ (for latching the lower order of the F number). In this embodiment, the F number is set to be 16-bit.

Since an ordinary 8-bit output type memory is used as the F number memory 2, the high-order eight bits of the F number are stored in the memory 2 at the position where the least significant bit of an address signal is 0 and the low-order eight bits are stored at the position where the least significant bit is 1. Accordingly, ROM $N_H/N_L$ selecting signal is connected to at least significant bit address of the F number memory 2. Table 1 shows examples of F numbers which are stored corresponding to addresses thus given. For the key information from the key assignor 1, codes representing notes are caused to correspond to addresses other than the least significant bit addresses.

TABLE 1

| Address | F number stored |
|---|---|
| 00000000 | High-order eight bits of $C_2$ |
| 00000001 | Low-order eight bits of $C_2$ |
| 00000010 | High-order eight bits of $C\#_2$ |
| 00000011 | Low-order eight bits of $C\#_2$ |
| 00000100 | High-order eight bits of $D_2$ |
| 00000101 | Low-order eight bits of $D_2$ |
| ⋮ | ⋮ |

Figure 4:
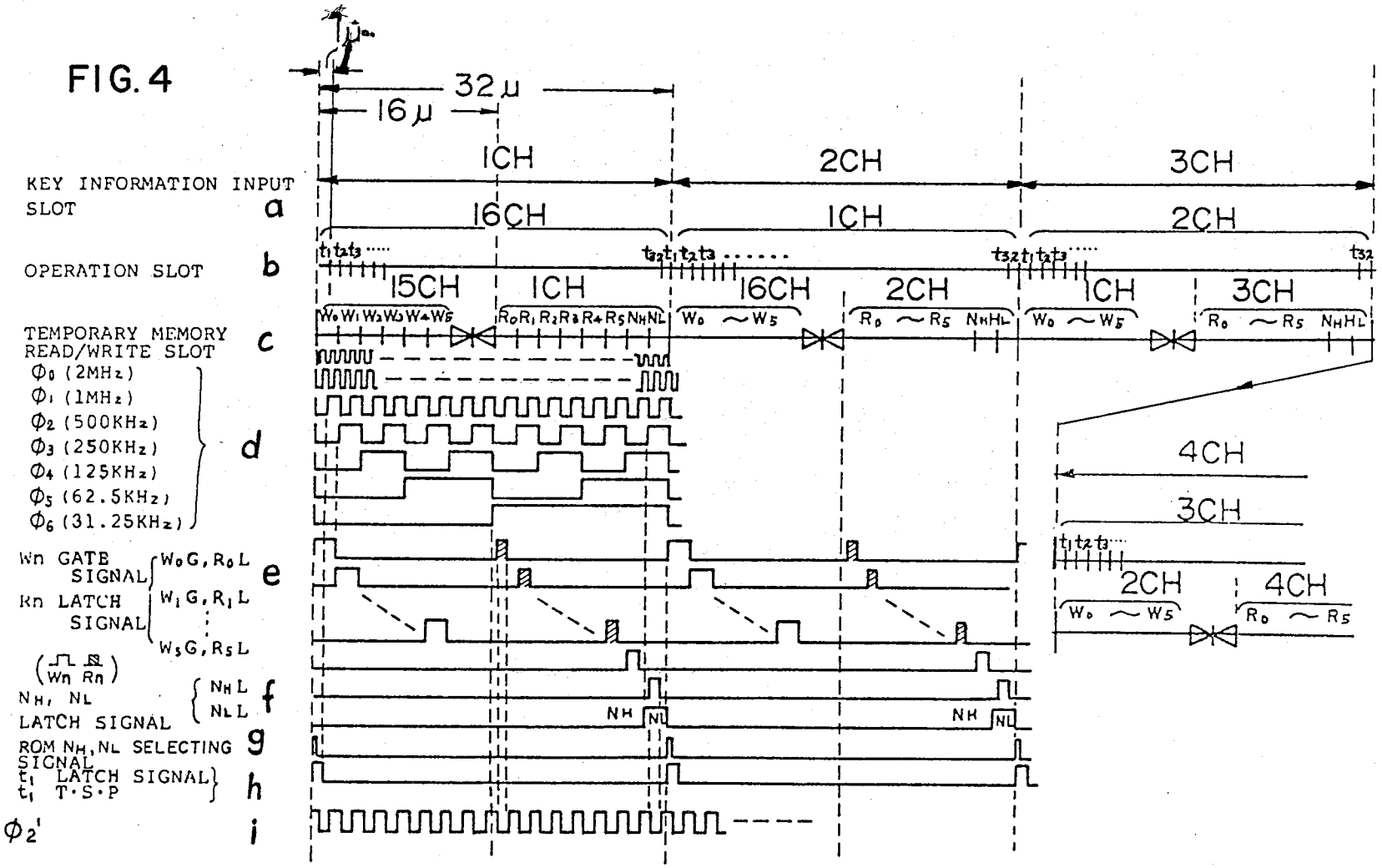
FIG. 4 is a timing chart explanatory of the operation of the embodiment depicted in FIG. 2.

As shown in FIGS. 4(*a*) to (*c*), the operation for the channel 1 is performed following timing slots $t_1$ to $t_{32}$ in the period in which the key information input slot is a channel 2 but the operation is impossible with the F number alone. For each operation, the result of the previous operation is required. By address information from the control circuit 19, the operation result is read out from the temporary memory 12 by steps of four bits in read slots $R_0$, $R_1$, . . . $R_5$. In this embodiment, an ordinary 4-bit output type memory is employed as the temporary memory 12.) and latched by latch signals $R_0L$, $R_1L$, . . . $R_5L$ and stored in the register (#2)13. The F number is read out in the subsequent read slots $N_H$ and $N_L$ and stored in a first stage of the register (#1)11. In this way, the F number and the previous operation result necessary for the operation for the channel 1 which is executed in the next channel 2 are prepared while the key information input slot is the channel 1. On the other hand, if the result of an operation for a channel 15 which is executed when the key information input slot is a channel 16 is not stored in the temporary memory 12, then an operation in the next channel 15 cannot be executed, so that the result of the last operation is latched by a $t_1$ latch signal and stored in the register (#3)18. By address information from the control circuit 19, this operation result is written, by steps of four bits, in the temporary memory 12 put in its write state by $\phi_6$, via gates which are turned ON by gate signals $W_0G$, $W_1G$, . . . $W_5G$.

In this way, there is set up in the temporary memory 12 an area of at least six words for each of the channels 1 to 16 as shown in FIG. 4(*c*). When the key information input slot is the channel 2, the F number of the channel 2 is similarly read out from the F number memory 2 and, at the same time, the operation results of the channels 2 and 16 are respectively read out from the temporary memory 12 or stored therein. Of the F number corresponding to the channel 1 and the previous operation result which are necessary for the operation of the channel 1, the operation result loaded in the register (#2)13 is sent out to the selector 14 in preparation for the current operation. The F number loaded in the first stage of the register (#1)11 is shifted to a second stage by the $t_1$ latch signal which provides timing in the second stage becomes unnecessary for the operation.

Upon receiving a $t_1$ time slot pulse, the selector 14 provides the previous operation result to the adder 15 in a first time slot. Accordingly, the previous operation result and the F number are added together in the adder 15. The added output is latched and stored in the register (#4)16 by the rise of $\overline{\phi_1}$ representing the start of the time slot $t_2$. Further, the added output is written in the buffer memory 17 by buffer memory address information from the control circuit 19 and $\overline{\phi_1}$ which puts the buffer memory 17 in its write state in the latter half of the time slot $t_1$. After the time slot $t_2$ the selector 14 provides the output from the register (#4)16 to the adder 15, so that the F number is added for each of the time slots $t_2$, $t_3$, $t_4$, . . . $t_{32}$ and the added result is derived at the output of the adder 15. The operation result is transferred to and loaded in the buffer memory 17 by $\overline{\phi_1}$ and the address information from the control circuit 19.

The operations described above are sequentially performed in the channels 1 to 16. The operation data which is transferred to the buffer memory 17 in this time is as large as 32 words$\times$16=512 words.

Figure 5:
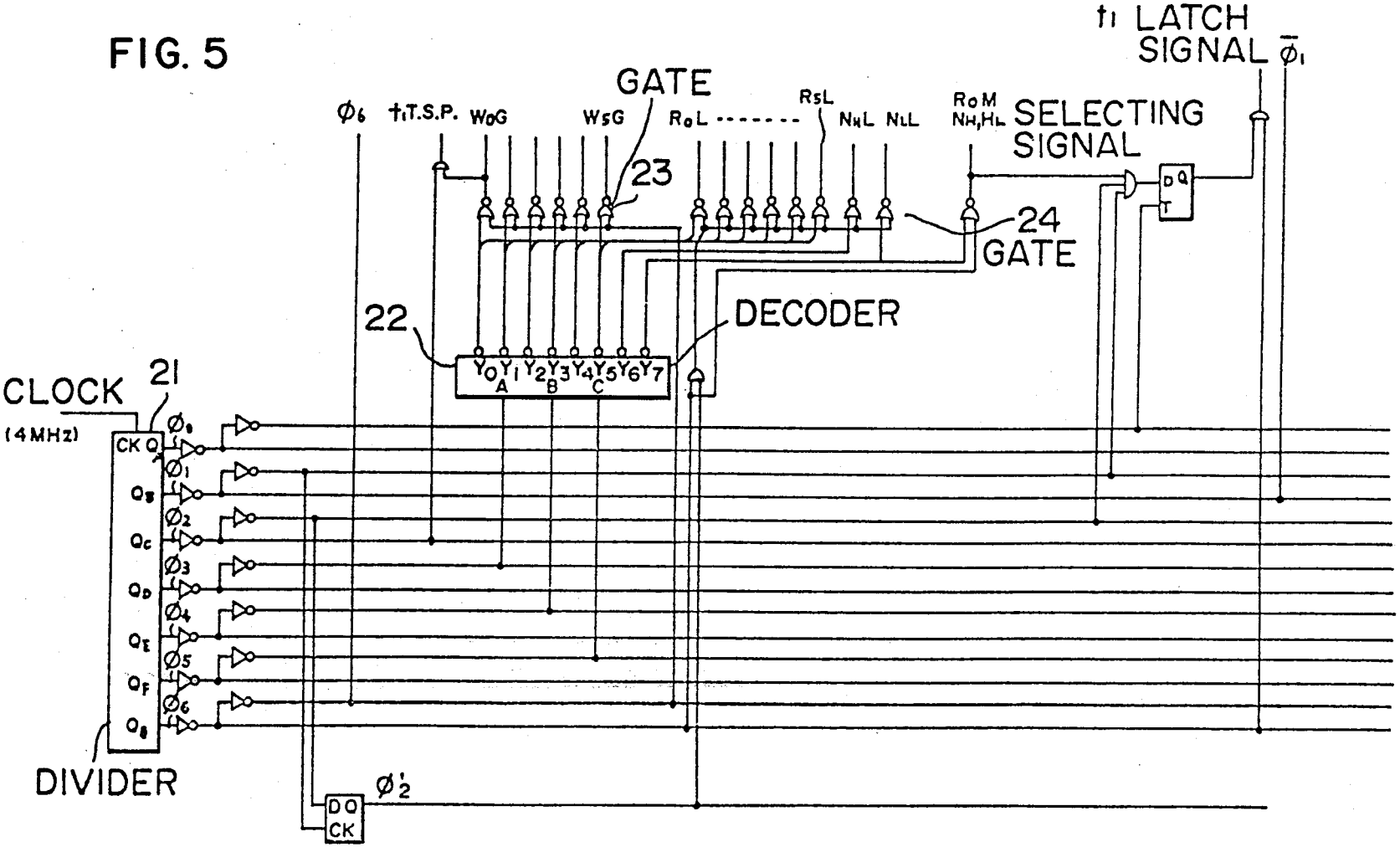
FIG. 5 is a connection diagram illustrating a specific example of one part of a control circuit employed in the embodiment of FIG. 2.

$\phi_1$ to $\phi_6$ in FIG. 4(*d*) show the waveforms of frequency dividing clocks of 4 MHz and FIGS. 4(*e*) to (*j*) show the timing of generation of control signals which are supplied from the control circuit 19 to the respective components described above. FIG. 4(*e*) show the write gate signal $W_nG$ and the read latch signal $R_nL$ for the temporary memory 12, FIG. 4(*f*) the latch signals $N_H1$ and $N_LL$ for loading the F number in the register (#1)11, FIG. 4(*g*) the ROM $N_{H/NL}$ select signal and FIG. 4(*b*) the aforesaid operation slot $t_1$ latch signal and $t_1$ time slot pulse. FIG. 5 illustrates an example of the circuit arrangement of the control circuit 19 for generating control signals of predetermined timing which are applied to respective circuits. A fundamental clock of 4 MHz is applied to a frequency divider, wherein it is divided into frequencies $\phi_0$ to $\phi_6$ such as shown in FIG. 4(*d*), which are each divided into a normal output and an inverted output. These outputs are provided via a decoder 22 to gate groups 23 and 24, whereby it is possible to produce the write gate signal $W_nG$ and the read latch signal $R_nL$ depicted in FIG. 4(*e*). In a likewise manner, the other control signals shown in FIGS. 4(*f*) to (*i*) can be obtained through the use of required gates or flip-flops but no detailed description will be given.

With the above arrangement, the operation data 512 words of the channels 1 to 16 are transferred by the address information from the control circuit 19 to the buffer memory 17 to obtain frequency information but, in this case, it is necessary to prevent that the non-real time basis in the operation affects the frequency information. Table 2 shows an example of the arrangement of the buffer memory 17 for such a purpose.

TABLE 2

| | Area A | | | Area B |
|---|---|---|---|---|
| Address | 1 . . . 32 | 33 . . . 64 | . . . 481 . . . 512 | Same as left |
| Slots for operation of loaded data | $t_1 \ldots t_{32}$ | $t_1 \ldots t_{32}$ | $\ldots t_1 \ldots t_{32}$ | |
| | 1CH | 2CH | 16CH | |

Two 512-word memory areas A and B are provided, which are used for read and transfer alternately with each other. At first, the operation data are transferred to respective addresses of the area B in the order 1CH 1, 2, . . . 32, 2CH 33, 34, . . . 64 . . . 16CH 481, 482 . . . . In synchronism with this transfer data previously transferred to and stored in the area A are read out therefrom in the order 1CH, 2CH, . . . 16CH, that is, in the order of addresses 1, 33, . . . 481, 2, 34, . . . 482, . . . 32, 64, . . . 512. The data transfer to the area B is completed before completion of the readout of the area A. Next, the data thus stored in the area B is read out therefrom and data is transferred to the area A. The influence of the non-real time operation can be eliminated by operating the data as one group for each channel on the non-real time basis in the one area and by reading out the data from the other area on the time divided basis for each channel. Further, according to this method, when the clock input is set to 4 MHz, 32 $\mu s \times 16$ channels $= 512\ \mu s$ corresponds to 32 sample points of each channel as seen from FIG. 4, so that the sample frequency of the essential frequency information is 62.5 KHz. This is the same as in the case of FIG. 1 but since the access time slots of the F number memory 2 and the temporary memory 12 can be set to 2 $\mu s$ as depicted in FIGS. 4(*e*) to (*g*), there is no need of employing high-speed, expensive memory elements. This is very advantageous for the reduction of manufacturing costs and the stabilization of performance.

In the present invention, the registers (#1)11, (#2)13, (#3)18 and (#4)16, the selector 14 and the adder 15 shown in FIG. 3 can be constituted by the master slice system of the semi-custom LSI and the number of input-/output lines required is 31, which can sufficiently be accomodated in the existing master slice. The smaller the number of input/output lines is, the lower the cost of the master slice becomes. The buffer memory and the temporary memory can also be formed by inexpensive memory elements of 4 bits $\times$ 1K word structure.

Figure 1:
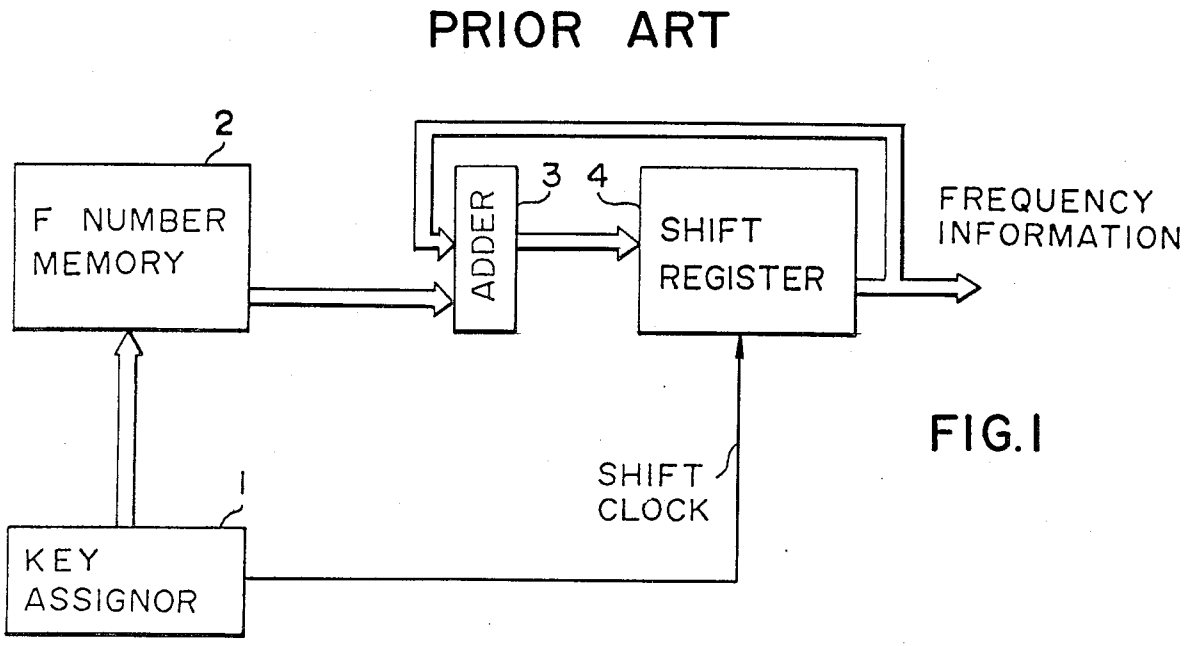
FIG. 1 is a block diagram showing a prior art example.

In the case where the prior art example of FIG. 1 accumulates the frequency number on a real time basis using a shift register, a first problem is that high-speed clocks are needed which calls for expensive memory elements and a second problem is that since a number of gates are required in the shift register, it is impossible to employ a master slice of a recent economical semi-custom LSI. In the present invention, a buffer memory and a temporary memory are provided in place of the shift register and there are provided between the buffer memory and the temporary memory an F number memory latch register, a temporary memory write/read register and an accumulator composed of a selector, an adder and a register. With such an arrangement, by providing two areas in the buffer memory and by alternating read and write of operation data between the two areas, the access time slots of the F number memory and the temporary memory can be extended twice as long as in the prior art, permitting the use of inexpensive memory elements; thus, the abovesaid first problem of the prior art can be settled. With respect to the second problem, the arrangement between the buffer memory and the temporary memory can completely be master-sliced, providing stable performance and low cost.

As has been described in the foregoing, according to the present invention, it is possible to obtain an electronic musical instrument which appears to be more complex than the prior art arrangement of FIG. 1 but is completely free from problems in practical use, inexpensive as a whole and stable in performance.

It will be apparent that many modifications and variations may be effected without departing from the scope of the novel concepts of this invention.

What is claimed is:

1. A frequency information generating device for electronic musical instruments having a plurality of keys each corresponding to a note and a key assignor for providing key information corresponding to each key, each key information having a time slot in one of a plurality of channels, the device, comprising:

a frequency number memory for storing a frequency number corresponding to the note of each key and delivering the frequency number corresponding to the key information from the key assignor;

accumulating means composed of a selector, an adder and a register;

a temporary memory responsive to the output of said register for storing the results of accumulation obtained by accumulating the frequency number from the frequency number memory by the accumulating means a predetermined number of times; and a buffer memory responsive to the output of said adder for storing the result of each accumulation by the accumulating means and outputting frequency information;

the output of the frequency number memory being applied to one input of the adder of the accumulating means; either one of the output of the temporary memory or the output of the register having stored therein the output of the adder being selectable by the selector for input to another input of the adder; and the output of the register being applied to the input of the temporary memory.

2. A frequency information generating device for electronic musical instruments according to claim 1 comprising a control circuit for controlling the selector to accumulate the frequency number by adding the frequency number from the frequency number memory and the previous accumulation results from the temporary memory by the adder in a first accumulation of said predetermined number of times and by adding the frequency number and the output of the register in second and subsequent accumulations and for performing processing in which, while the frequency number of key information of a certain channel is accumulated by the accumulating means, the results of accumulation of key information of an immediately preceding channel carried out the predetermined number of times are written in the temporary memory and the previous results of accumulation of key information of the next channel are read out from the temporary memory and, at the same time, the frequency number corresponding to the key information of the next channel is read out from the frequency number memory, thereby making preparations for an operation of the frequency number of key information of the next channel after the accumulation being executed from said certain channel is carried out said predetermined number of times.

3. A frequency information generating device for electronic musical instruments according to claim 1 wherein the buffer memory has two areas, each formed by a selected number of words there being a word for each time slot of each channel; the result of each accumulation by the accumulating means being written in a corresponding word of one of the areas and read out by scanning the corresponding word of the other area; and the write/read being performed alternately with the two areas.

* * * * *